US008333298B2

(12) United States Patent
Wojcik et al.

(10) Patent No.: US 8,333,298 B2
(45) Date of Patent: Dec. 18, 2012

(54) STORAGE CONTAINER WITH A COLLAPSIBLE BELLOWS UNIT

(75) Inventors: Michael A. Wojcik, Lemont, IL (US); Kelly Sanborn, Naperville, IL (US)

(73) Assignee: Blistex Inc., Oak Brook, IL (US)

( * ) Notice: Subject to any disclaimer, the term of this patent is extended or adjusted under 35 U.S.C. 154(b) by 852 days.

(21) Appl. No.: 12/325,594

(22) Filed: Dec. 1, 2008

(65) Prior Publication Data

US 2010/0133281 A1 Jun. 3, 2010

(51) Int. Cl.
*B65D 6/18* (2006.01)

(52) U.S. Cl. ..... 220/666; 220/529; 222/390

(58) Field of Classification Search ..... 220/495.01, 220/23.9, 489, 666, 529, 544, 23.86; 383/120; 215/11.3; 206/577, 817, 223, 218, 216, 761, 206/751; 221/64, 65, 751, 761, 37; 312/306; 222/326, 386.5, 390
See application file for complete search history.

(56) References Cited

U.S. PATENT DOCUMENTS

| | | | | |
|---|---|---|---|---|
| 2,880,902 | A | 4/1959 | Owsen | |
| 3,155,281 | A * | 11/1964 | Stracey | 222/107 |
| 3,335,913 | A | 8/1967 | Bouet | |
| 3,390,821 | A | 7/1968 | Mullan | |
| 3,587,937 | A | 6/1971 | Childs | |
| 3,833,154 | A | 9/1974 | Markowitz | |
| 3,951,310 | A | 4/1976 | Steiman | |
| 4,187,960 | A | 2/1980 | Bonk | |
| 4,865,211 | A | 9/1989 | Hollingsworth | |
| 5,137,183 | A | 8/1992 | Mikulec et al. | |
| 5,356,025 | A * | 10/1994 | Renault | 220/263 |
| 5,439,125 | A | 8/1995 | Bloch | |
| 5,924,151 | A | 7/1999 | Connan | |
| 6,655,550 | B2 * | 12/2003 | Garcia et al. | 222/103 |
| 6,736,285 | B2 | 5/2004 | Stewart-Stand | |
| 2008/0179323 | A1 * | 7/2008 | Circosta et al. | 220/8 |
| 2010/0193460 | A1 * | 8/2010 | Driver et al. | 215/11.3 |

* cited by examiner

*Primary Examiner* — Anthony Stashick
*Assistant Examiner* — Jeffrey Allen
(74) *Attorney, Agent, or Firm* — Ladas & Parry LLP

(57) ABSTRACT

A storage container having a collapsible unit and a twist cap is described. The collapsible unit is a type of bellows which includes a base and a sidewall attached to the base. The sidewall has a spiral fold that traverses along a portion of the length of that the collapsible unit. The length can be compressed by folding the collapsible unit along the spiral fold. As the length of the collapsible unit is reduced, access to any remaining products, such as acne pad products, stored at the bottom of the collapsible unit can be more conveniently obtained. The cap of the storage container includes a ring collar; a sleeve attached to the ring collar; and a guide attached to the sleeve. When the cap is turned or twisted the guide and the spiral fold are configured to slidably engage each other which results in shortening the length of the collapsible unit.

3 Claims, 4 Drawing Sheets

STORAGE CONTAINER WITH A COLLAPSIBLE BELLOWS UNIT

FIELD OF THE INVENTION

The present invention relates to storage containers accessories, more particularly to a storage container device with a collapsible bellow unit for use in providing the user easy access to products stored at the bottom of the container.

DESCRIPTION OF THE PRIOR ART

A wide variety of storage container devices is currently available on the commercial market and an even larger number of these types of devices are known in the art of storage containers devices, for example the collapsible article disclosed by Owsen in U.S. Pat. No. 2,880,902; the pressure dispensing device for fluid material disclosed by Bouet in U.S. Pat. No. 3,335,913; the collapsible dispensing container disclosed by Markowitz in U.S. Pat. No. 3,833,154; the spring-charge aerosol dispenser disclosed by Steiman in U.S. Pat. No. 3,951,310; the dispenser with cap and protective member disclosed by Bonk in U.S. Pat. No. 4,187,960; the collapsible article disclosed by Hollingsworth in U.S. Pat. No. 4,865,211; and the compressible feeding apparatus disclosed by Mikulect et al. in U.S. Pat. No. 5,137,183.

While all of the above-described devices fulfill their respective, particular objectives and requirements, the aforementioned patents do not describe a storage container device having a collapsible bellows unit that can be contracted in length by twisting the cap of the device so that the user may be able to more easily reach into the bottom of the storage volume of the bellows for any remaining product stored within the device. This combination of elements would specifically match the user's particular individual needs of making it possible to provide a means for allowing a user a more convenient way of reaching to the bottom of the storage vessel to obtain any remaining product stored within the vessel. The above-described patents make no provision for a storage container device having a collapsible bellows unit that can be contracted in length by twisting the cap.

Therefore, a need exists for a new and improved storage container device having a collapsible bellows unit that can be contracted in length by twisting the cap. In this respect, the storage container device according to the present invention substantially departs from the conventional concepts and designs of the prior art, and in doing so provides an apparatus primarily developed for the purpose of providing a convenient means for making it possible to allow a user a more convenient way of reaching to the bottom of the storage vessel to obtain any remaining product stored within the vessel.

SUMMARY OF THE INVENTION

The present device and kit, according to the principles of the present invention, overcomes a number of the shortcomings of the prior art by providing a novel storage container device and kit for use in allowing a user a more convenient way of reaching into the bottom of the storage vessel to obtain any remaining product stored within the vessel. The device includes a collapsible unit and a cap. The kit includes the un-interconnected elements of the device.

In view of the foregoing disadvantages inherent in the known type storage container devices now present in the prior art, the present invention provides an improved storage container device, which will be described subsequently in great detail, is to provide a new and improved storage container device which is not anticipated, rendered obvious, suggested, or even implied by the prior art, either alone or in any combination thereof.

To attain this, the present invention essentially comprises storage container comprising a collapsible unit and a cap. The collapsible unit includes a base; and a sidewall attached to the base, the sidewall having a spiral fold. The cap includes a ring collar; a sleeve attached to the ring collar; and a guide attached to the sleeve wherein the guide being slidably engaged with the spiral fold of the sidewall of the collapsible unit.

The invention may also include an outer shell, a lid, as well as, a product stored within the storage container device.

It is therefore an aspect of the present invention to provide a new and improved storage container device that has many of the advantages of the prior storage container devices and minimizing a number of their disadvantages.

It is another aspect of the present invention to provide a new and improved storage container device that may be easily and efficiently manufactured and marketed.

An even further aspect of the present invention is to provide a new and improved storage container device that has a low cost of manufacture with regard to both materials and labor, and which accordingly is then susceptible of low prices of sale to the consuming public, thereby making storage container economically available to the buying public.

Still another aspect of the present invention is to provide a storage container device that provides in the apparatuses and methods of the prior art some of the advantages thererof, while simultaneously overcoming some of the disadvantages normally associated therewith.

Even still another aspect of the present invention is to provide a storage container device having a collapsible unit and a cap. The collapsible unit includes a base; and a sidewall attached to the base, the sidewall having a spiral fold. The cap includes a ring collar; a sleeve attached to the ring collar; and a guide attached to the sleeve wherein the guide being slidably engaged with the spiral fold of the sidewall of the collapsible unit.

Still another aspect of the present invention is to provide a kit comprising the un-interconnected elements of the device.

Unless otherwise defined, all scientific and technical terms used herein are to be construed as having the same meaning as commonly understood by one of ordinary skill in the art to which this invention pertains. Although methods and materials similar or equivalent to those described herein can be used in the practice or testing of the present invention, the preferred methods and materials are described below. Unless otherwise indicated, materials, methods, and examples described herein are illustrative only and not intended to be limiting.

There has thus been outlined, rather broadly, the more important features of the invention in order that the detailed description thereof that follows may be better understood, and in order that the present contribution of the art may be better appreciated.

Numerous other features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Before undertaking the detailed description of the invention below, it may be advantageous to set forth definitions of certain words and phrases used throughout this patent document. Throughout this specification, unless the context requires otherwise, the word "comprise" or variations such as "comprises" or "comprising" or the term "includes" or variations, thereof, or the term "having" or variations, thereof will be understood to imply the inclusion of a stated element or integer or group of elements or integers but not the exclusion of any other element or integer or group of elements or integers. Furthermore, a person skilled in the art of reading claimed inventions should understand that "a" and "an" each generally denotes "at least one," but does not exclude a plurality unless the contextual use dictates otherwise. And that the term "or" denotes "at least one of the items," but does not exclude a plurality of items of the list.

Those skilled in the art will appreciate that the invention described herein is susceptible to variations and modifications other than those specifically described. It is to be understood that the invention includes all such variations and modification which fall within its spirit and scope.

BRIEF DESCRIPTION OF THE DRAWINGS

The invention will be better understood and aspects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
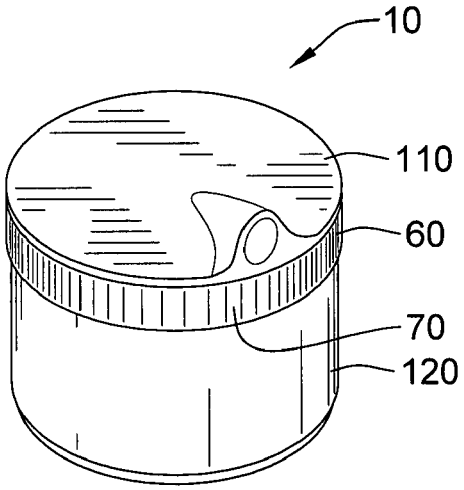
FIG. 1 depicts a perspective view of a preferred embodiment of the storage container of the present invention.

The following detailed embodiments presented herein are for illustrative purposes. That is, these detailed embodiments are intended to be exemplary of the present invention for the purposes of providing and aiding a person skilled in the pertinent art to readily understand how to make and use of the present invention. Accordingly, the detailed discussion herein of one or more embodiments is not intended, nor is to be construed, to limit the metes and bounds of the patent protection afforded the present invention, in which the scope of patent protection is intended to be defined by the claims and their equivalents thereof. Therefore, embodiments not specifically addressed herein, such as adaptations, variations, modifications, and equivalent arrangements, should be and are considered to be implicitly disclosed by the illustrative embodiments and claims described herein and therefore fall within the scope of the present invention.

One preferred embodiment of the storage container 10 comprises a collapsible unit 20 and a cap 60. The collapsible unit 20 comprises a base 30 and a sidewall 40 attached to the base 30 in which the sidewall 40 has a spiral fold 50. The cap 60 comprises a ring collar 70, a sleeve 80 and a guide 90. The sleeve 80 is attached to the ring collar 70 and the guide 90 is attached to the sleeve 80 in which the guide 90 is slidably engaged with the spiral fold 50 of the sidewall 40 of the collapsible unit 20. The collapsible unit 20 is configured to contract in length when the cap 60 is turned, relative to the collapsible unit 20, so that the guide 90 slides along the spiral fold 50 of the sidewall 40 and results in folding a portion of the collapsible unit 20 between the guide 90 and the ring collar 70. The collapsible unit 20 may also be configured to expand in length when the cap 60 is turned, relative to the collapsible unit 20, so that the guide 90 slides along the spiral fold 50 of the sidewall 40 and results in unfolding a portion of the collapsible unit 20 between the guide 90 and the ring collar 70. The sidewall 40 and the sleeve 80 are preferably substantially cylindrical in shape, and the lip 100 and the ring collar 70 are preferably substantially annular in shape. The guide 90 may be any shape as long as the guide 90 slidably engages with the spiral fold 50 of the sidewall 40 of the collapsible unit 20. One preferred configuration of the guide 90 is that it is spiral shaped. Further the guide 90 is may be attached to either the outer or inner surfaces of the sleeve 80.

A lip 100 may also be added to the storage container 10 in which the optional lip 100 is attached to the sidewall 40 of the collapsible unit 20.

A lid 110 may also be added to the storage container 10 in which the optional lid 110 is attached to the ring collar 70. The optional lid 110 may be any type of configuration such as those selected from the group consisting of a flip top lid 110, pop-off lid 110, a screw top lid 110 and a nozzle lid 110.

An outer shell 120 may also be added to the storage container 10 in which the optional outer shell 120 is rotatably attached to the cap 60 in which the outer shell 120 is configured to contain the collapsible unit 20. The optional outer shell 120 may also have at least one channel 140 such that the collapsible unit 20 has a least one matching nub 130 in which the nub 130 and the channel 140 are configured to mate together to substantially restrict the collapsible unit 20 from turning, relative to the outer shell 120, when the outer shell 120 is turned relative to the cap 60. The optional outer shell 120 may also have at least one nub 130 such that the collapsible unit 20 has a least one channel 140 in which the nub 130 and the channel 140 are configured to mate together to substantially restrict the collapsible unit 20 from turning, relative to the outer shell 120, when the outer shell 120 is turned relative to the cap 60.

A product 150 may also be added to the storage container 10 in which the optional product 150 is mounted within the collapsible unit 20. The product 150 may be any type of known product 150 article, as long as, the product 150 is able to be mounted within the confines of the collapsible unit 20. One preferred embodiment is that the product 150 is a plurality of stacked acne treatment pads. Other preferred embodiments is that the product 150 is selected from the group consisting of a cream product 150, a lotion product 150, a viscous oil product 150, a gel product 150, a grease product 150, an eye shadow product 150, a blush product 150, a powder product 150, a food stuff product 150, a lipstick product 150, a lip 100 balm product 150, an eyeliner product 150, a mascara product 150, a hair care conditioner product 150. Still yet other preferred embodiments is that the product 150 is selected from the group consisting of an absorbent article, a cellulose based tissue product 150, a cellulose/polypropylene based tissue product 150, a cotton based tissue product 150, and a wool based tissue product 150.

A handle 170 may also be added to the storage container 10 in which the optional handle 170 is attached to the collapsible unit 20.

Another preferred embodiment of the storage container 10 comprises: a collapsible unit 20, a cap 60, an outer shell 120, and a product 150 stored within the storage container 10. The collapsible unit 20 comprising: a base 30; a sidewall 40 attached to the base 30 in which the sidewall 40 has a spiral fold 50; and a lip 100 attached to the sidewall 40 wherein the lip 100 having a least one nub 130. The cap 60 comprises: a ring collar 70; a lid 110 attached to the ring collar 70; a sleeve 80 attached to the ring collar 70; and a guide 90 attached to the sleeve 80. The guide 90 has a spiral shape in which the guide 90 is slidably engaged with the spiral fold 50 of the sidewall 40 of the collapsible unit 20 such that the collapsible unit 20 is configured to contract in length when the cap 60 is turned, relative to the collapsible unit 20. Thereby, as the cap 60 is turned, the guide 90 slides along the spiral fold 50 of the sidewall 40 and results in forcing a portion of the collapsible unit 20 to become folded between the guide 90 and the ring collar 70. The outer shell 120 is slidably and rotatably attached to the cap 60 in which the outer shell 120 contains the collapsible unit 20. The outer shell 120 having at least one channel 140 (preferably a plurality of channel 140*s*) in which the nub 130 (preferably plurality of nub 130*s*) on the lip 100 and the channel 140 in the outer shell 120 are configured to mate together to substantially restrict the collapsible unit 20 from turning, relative to the outer shell 120, when the outer shell 120 is turned relative to the cap 60. The product 150 is mounted within the collapsible unit 20.

One preferred embodiment of the kit 160 for the storage container 10 comprises the unconnected components of a collapsible unit 20 and a cap 60. The collapsible unit 20 comprises a base 30 and a sidewall 40 attached to the base 30 in which the sidewall 40 has a spiral fold 50. The cap 60 comprises a ring collar 70, a sleeve 80 attached to the ring collar 70, and a guide 90 attached to the sleeve 80 in which the guide 90 is slidably engageable with the spiral fold 50 of the sidewall 40 of the collapsible unit 20.

An optional product 150 may be added to the kit 160 in which the optional product 150 mounted within the collapsible unit 20.

An optional seal may be added to the kit 160 in which the optional is attached to the collapsible unit 20 hermetically sealing the product 150 within the collapsible unit 20.

An optional lid 110 may be added to the kit 160 in which the optional lid 110 is attachable to the ring collar 70. The optional lid 110 may be any known lid 110 configuration such as those lid 110 configurations selected from the group consisting of a flip top lid 110, pop-off lid 110, a screw top lid 110 and a nozzle lid 110.

An optional outer shell 120 may be added to the kit 160 in which the optional outer shell 120 is rotatably attachable to the cap 60 in which the outer shell 120 is configured to contain the collapsible unit 20.

An optional handle 170 may be added to the kit 160 in which the optional handle 170 is attached to the collapsible unit 20.

Referring now to FIG. 1 that depicts a perspective view of a preferred embodiment of the storage container 10 of the present invention. The storage container 10 is shown having an outer shell 120, connected to the ring collar 70 of the cap 60, and having a lid 110 attached to the cap 60.

Figure 2:
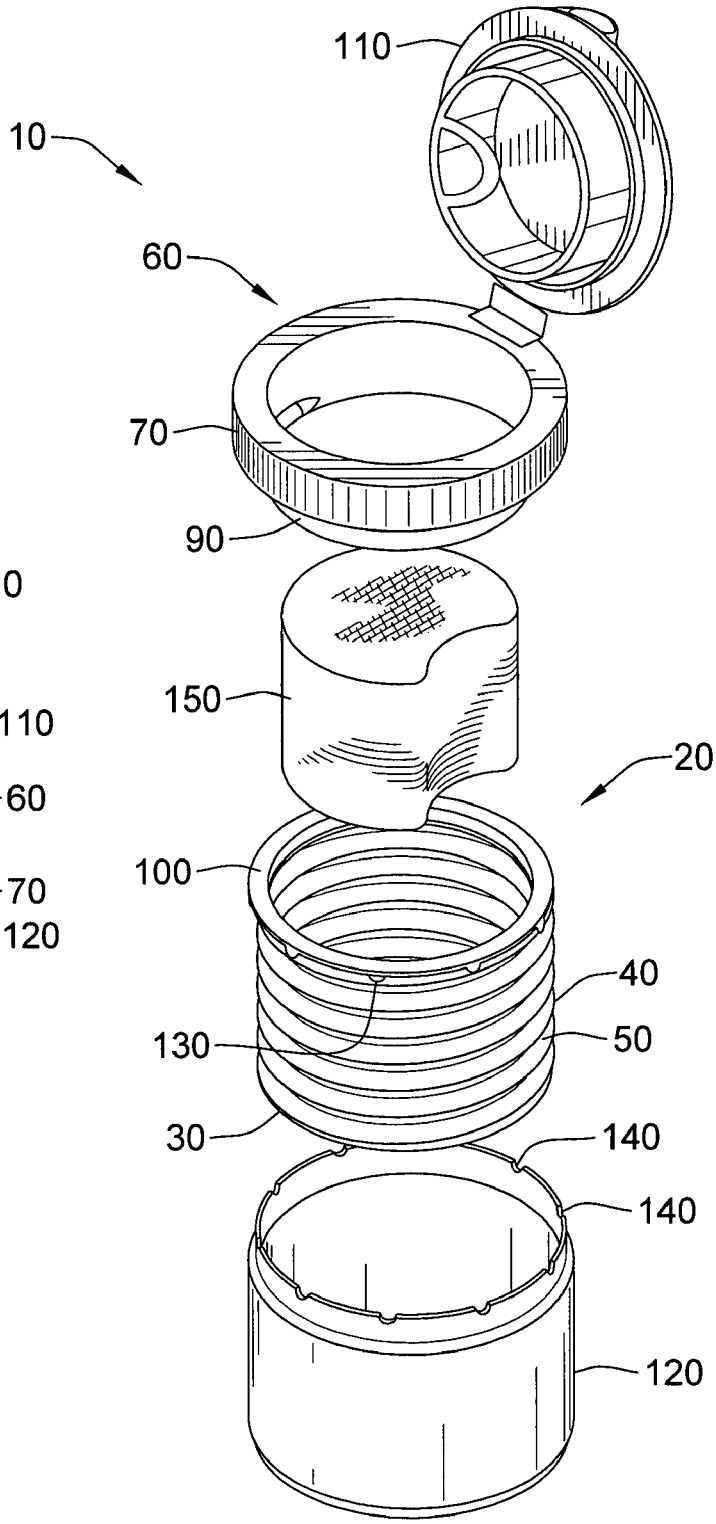
FIG. 2 illustrates an exploded perspective view of a preferred embodiment of the storage container of the present invention.

Referring now to FIG. 2 that illustrates an exploded perspective view of a preferred embodiment of the storage container 10 of the present invention. The storage container 10 is shown having a lid 110, a cap 60 composed of a ring collar 70, a sleeve 80 attached to the collar, and a guide 90 having a spiral shape attached at the bottom portion of the sleeve 80. Also shown is a product 150 that can fit within the collapsible unit 20. The collapsible unit 20 is shown including a base 30, sidewall 40 and a lip 100. The sidewall 40 is shown having a spiral fold 50 traversing lengthwise along the sidewall 40. The lip 100 is shown having a plurality of nub 130*s* attached to the lip 100. Also shown is the outer shell 120 that is configured to contain the collapsible unit 20. The outer shell 120 is shown having a plurality of channel 140*s* distributed along an upper portion in which the channel 140*s* of the outer shell 120 and the nub 130*s* of the lip 100 are configured to be mated together so as to restrain the collapsible unit 20 from turning when the cap 60 is turned.

Figure 3:
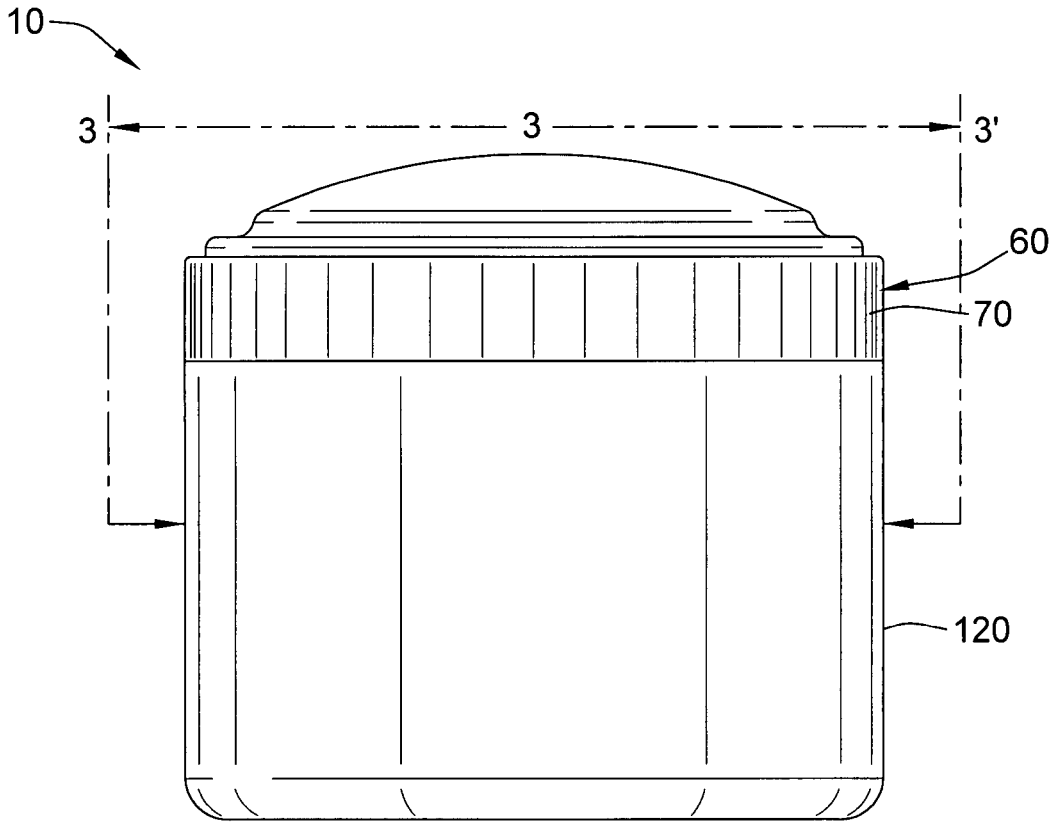
FIG. 3 depicts a side view of a preferred embodiment of the storage container of the present invention.

Referring now to FIG. 3 that depicts a side view of a preferred embodiment of the storage container 10. The outer shell 120 and the lid 110 are shown attached to the cap 60.

Figure 4:
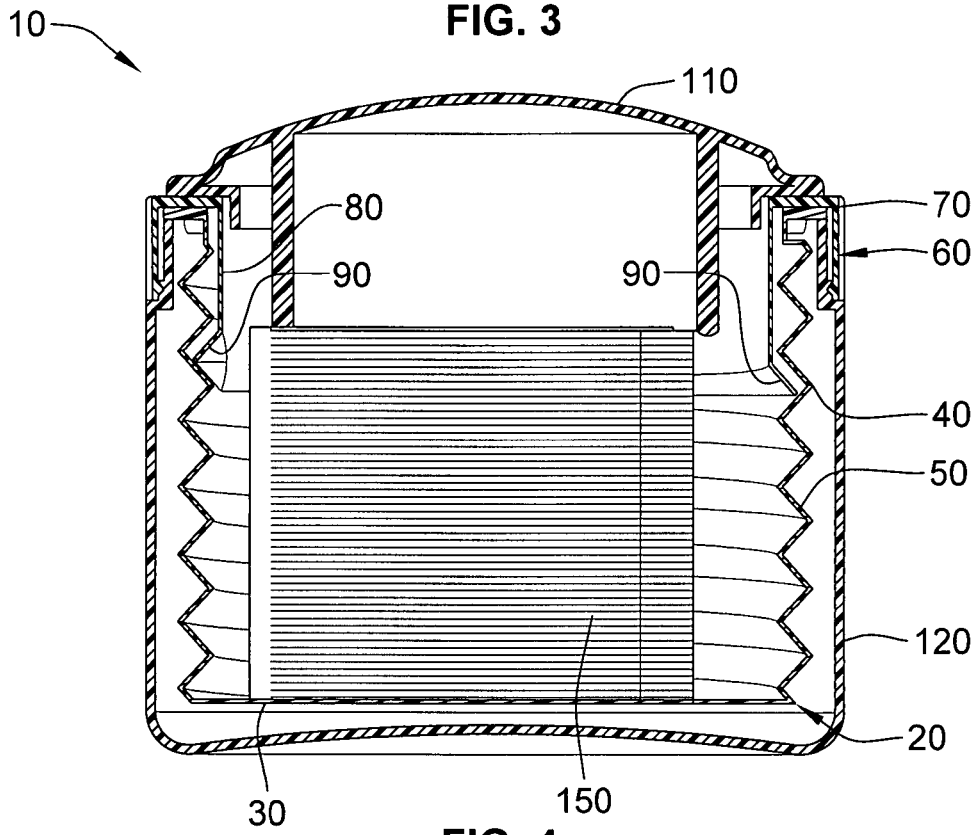
FIG. 4 depicts a cross sectional view of a preferred embodiment of the storage container 10 as illustrated in FIG. 3.

Referring now to FIG. 4 that depicts a cross sectional view of the preferred embodiment of the storage container 10 illustrated in FIG. 3. The outer shell 120 is shown slideably attached to the ring collar 70 of the cap 60. The sleeve 80 of the cap 60 is shown having the guide 90. The collapsible unit 20 is shown contained within the outer shell 120 in which the product 150 is shown mounted within the sidewall 40 and the base 30 of the collapsible unit 20. Also shown is the spiral fold 50 of the collapsible unit 20 engaged with the guide 90 of the cap 60. The lid 110 is shown attached to the cap 60.

Figure 5:
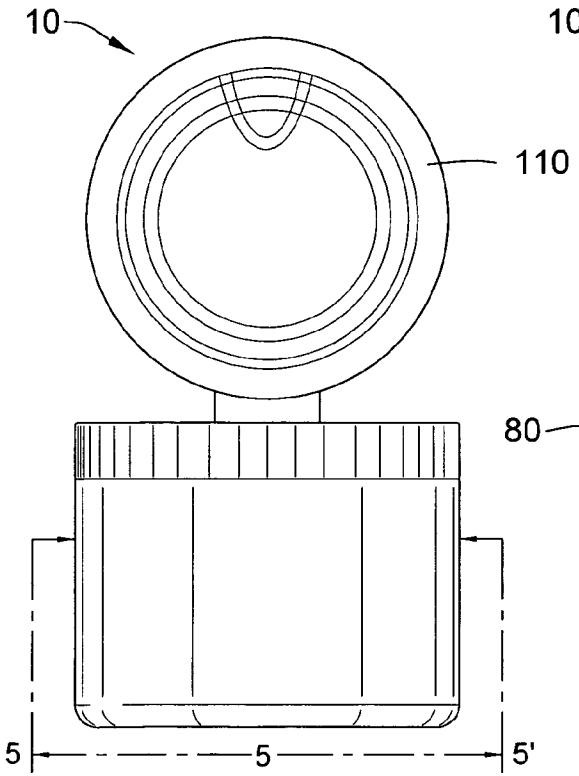
FIG. 5 depicts a front view of a preferred embodiment of the storage container of the present invention.

Referring now to FIG. 5 that depicts a front view of a preferred embodiment of the storage container 10 with the lid 110 opened. The outer shell 120 and the lid 110 are shown attached to the cap 60.

Figure 6:
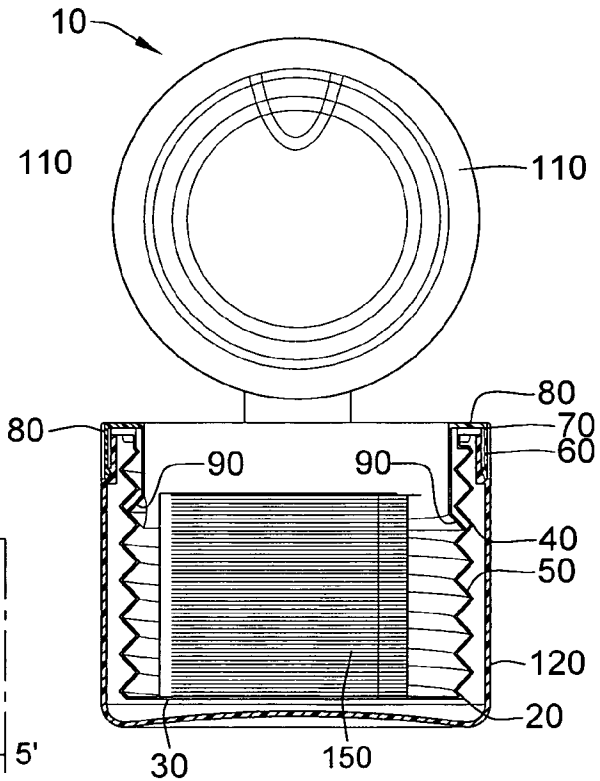
FIG. 6 depicts a cross sectional view of a preferred embodiment of the storage container of the present invention as illustrated in FIG. 5.

Referring now to FIG. 6 that depicts a cross sectional view of the preferred embodiment of the storage container 10 illustrated in FIG. 5 which contains the product 150. The outer shell 120 is shown slideably attached to the ring collar 70 of the cap 60. The sleeve 80 of the cap 60 is shown having the guide 90 near the bottom of the sleeve 80. The collapsible unit 20 is shown contained within the outer shell 120 in which the product 150 is shown nested within the sidewall 40 and the base 30 of the collapsible unit 20. Also shown is the spiral fold 50 of the collapsible unit 20 engaged with the guide 90 of the cap 60. The lid 110 is shown attached to the cap 60.

Figure 7:
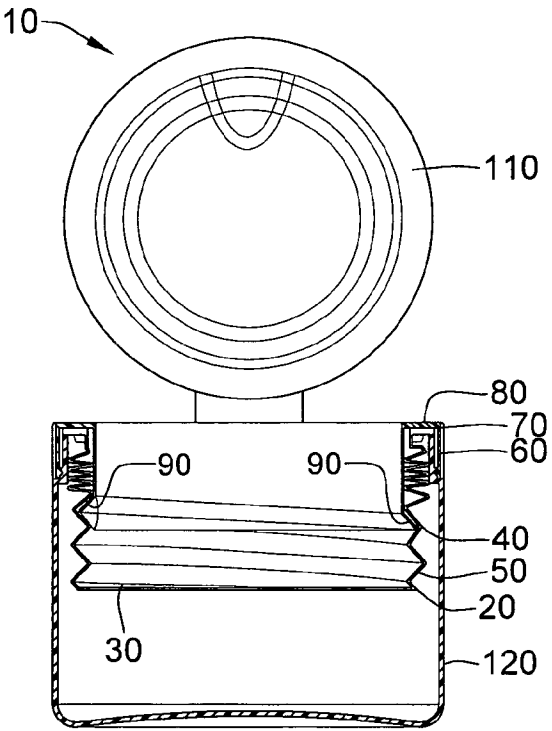
FIG. 7 depicts a cross sectional view of a preferred embodiment of the storage container of the present invention as illustrated in FIG. 5 with all of the product 150 removed.

Referring now to FIG. 7, a cross sectional view of the preferred embodiment of the storage container 10 is illustrated in FIG. 5 with all of the product 150 removed. The outer shell 120 is shown slideably attached to the ring collar 70 of the cap 60 so that the cap 60 can be turned which in turn lift the base 30 of the collapsible unit 20. The sleeve 80 of the cap 60 is shown having the guide 90 near the bottom of the sleeve 80. The collapsible unit 20 is shown mostly folded up within the outer shell 120 with the base 30 elevated nearer to the opening of the cap 60. Most of the sidewall 40 is shown folded up next to the sleeve 80 of the ring collar 70 due to turning of the cap 60. The turning of the cap 60, relative to the outer shell 120, results in driving the guide 90 to slidably along the spiral fold 50. As the guide 90 is slidably driven along the spiral fold 50, the portion of the sidewall 40 above the guide 90 is forced to fold up between the guide 90 and the cap 60. Accordingly, the sidewall 40 is forced to fold up between the guide 90 and the cap 60, the base 30 of the collapsible unit 20 elevates. This mechanism of lifting the base 30, provides a more convenient access to the lower portions of the product 150. Also shown is the lid 110 is attached to the cap 60.

Figure 8:
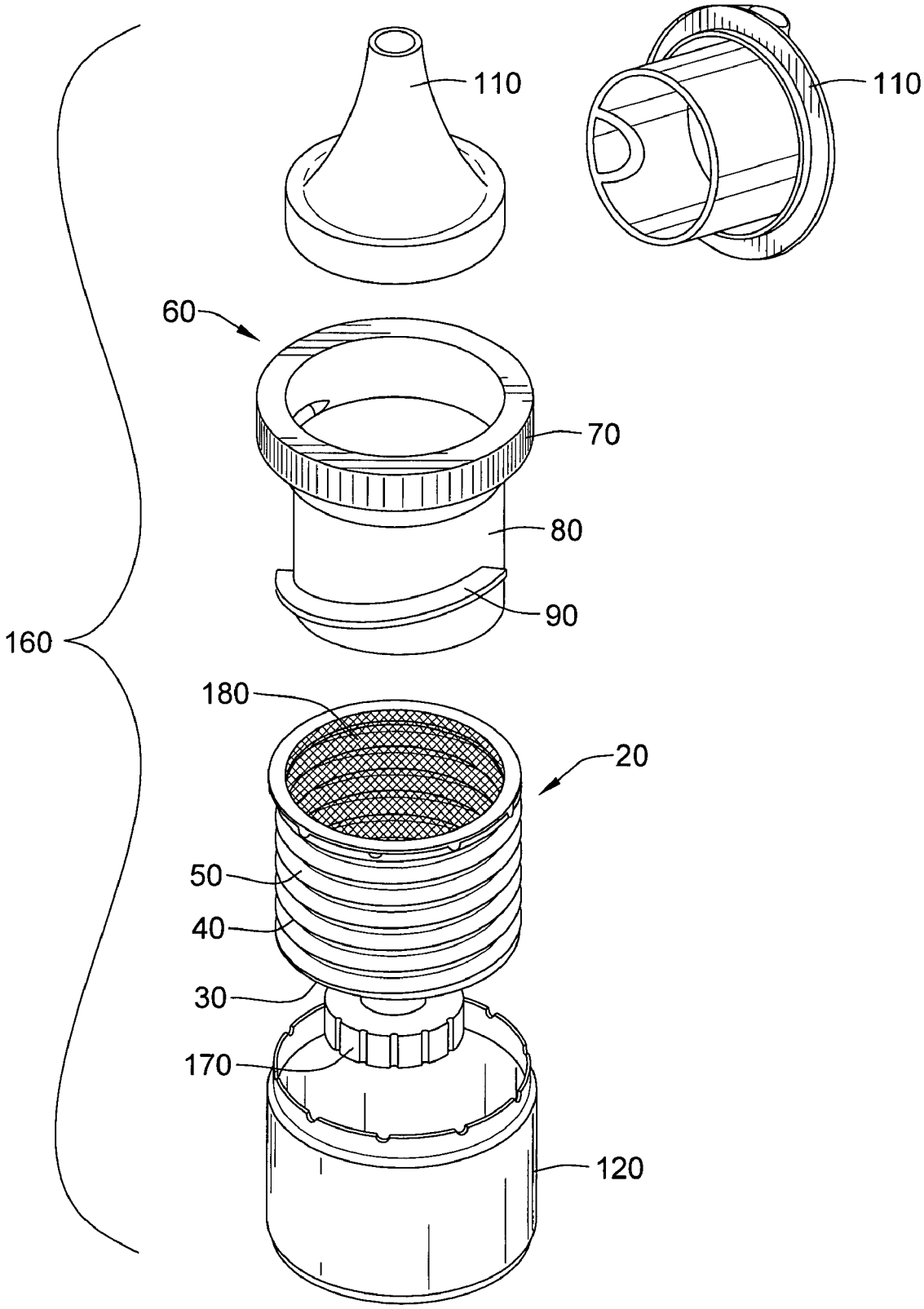
FIG. 8 depicts a preferred embodiment of the kit 160 for the storage container 10 of the present invention.

Referring now to FIG. 8, a preferred embodiment of the kit 160 for the storage container 10 is depicted. Shown are the unattached components of the lid 110, the cap 60, the collapsible unit 20, and the outer shell 120. The cap 60 is shown having a ring collar 70, a sleeve 80 and a guide 90 attached to the sleeve 80. The collapsible unit 20 is shown having a base 30, a sidewall 40 with a spiral fold 50. An optional handle 170 if shown attached to the base 30 of the collapsible unit 20. An optional seal liner 180 is shown which can hermetically seal the contents within the collapsible unit 20.

As to the manner of usage and operation of the present invention, the same should be apparent from the above description. Accordingly, no further discussion relating to the manner of usage and operation will be provided.

While a preferred embodiment of the storage container device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other aspects of the invention, along with the various features of novelty that characterize the invention, are pointed out with particularity in the claims annexed to and forming a part of this disclosure. For a better understanding of the invention, its operating advantages and the specific aspects attained by its uses, reference should be had to the accompanying drawings and description matter in which there are illustrated preferred embodiments of the invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A storage container comprising:

a collapsible unit comprising:

a base; and a sidewall attached to the base, the sidewall having a spiral fold; and a cap comprising:

a ring collar;

a sleeve attached to the ring collar; and a guide attached to the sleeve wherein the guide being slidably engaged with the spiral fold of the sidewall of the collapsible unit, and further comprising an outer shell rotatably attached to the cap, wherein the outer shell containing the collapsible unit, and further, wherein the outer shell having at least one channel, and the collapsible unit having a least one nub wherein the nub and the channel are configured to mate together to substantially restrict the collapsible unit from turning, relative to the outer shell, when the outer shell is turned relative to the cap.

2. A storage container comprising:

a collapsible unit comprising:

a base; and a sidewall attached to the base, the sidewall having a spiral fold; and a cap comprising:

a ring collar;

a sleeve attached to the ring collar; and a guide attached to the sleeve wherein the guide being slidably engaged with the spiral fold of the sidewall of the collapsible unit, and further comprising an outer shell rotatably attached to the cap, wherein the outer shell containing the collapsible unit, and further, wherein the outer shell having at least one nub, and the collapsible unit having a least one channel wherein the nub and the channel are configured to mate together to substantially restrict the collapsible unit from turning, relative to the outer shell, when the outer shell is turned relative to the cap.

3. A storage container comprising:

a collapsible unit comprising:

a base; and a sidewall attached to the base, the side wall having a spiral fold; and a cap comprising:

a ring collar;

a sleeve attached to the ring collar; and a guide attached to the sleeve or in the guide being slidably engaged with the spiral fold of the sidewall of the collapsible unit; and further comprising an outer shell rotatably attached to the cap, wherein the outer shell containing the collapsible unit, and wherein the collapsible unit is configured to expand in length when the cap is turned, relative to the collapsible unit, so that the guide slides along the spiral fold of the sidewall and results in unfolding a portion of the collapsible unit between the guide and the ring collar, and wherein the outer shell having at least one nub, and the collapsible unit having at least one channel wherein the nub and channel are configured to mate together to substantially restrict the collapsible unit from turning relative to the outer shell where the outer shell is turned relative to the cap.

* * * * *